United States Patent [19]

Speedie

[11] 4,263,697

[45] Apr. 28, 1981

[54] SECURITY SEAL

[75] Inventor: Robert Speedie, Victoria, Australia

[73] Assignee: Illinois Tool Works Inc., Chicago, Ill.

[21] Appl. No.: 45,026

[22] Filed: Jun. 4, 1979

[51] Int. Cl.[3] ..... B65D 63/00; B65D 77/10

[52] U.S. Cl. ..... 24/30.5 P; 24/16 PB; 24/17 AP; 24/30.5 L; 24/206 A

[58] Field of Search ..... 24/30.5 P, 30.5 R, 30.5 L, 24/30.5 W, 16 PB, 17 AP, 206 A, 255 SL

[56] References Cited

U.S. PATENT DOCUMENTS

| | | | |
|---|---|---|---|
| D. 234,204 | 1/1975 | Miller et al. | 24/255 SL |
| 3,082,794 | 3/1963 | Wahl | 24/30.5 W |
| 3,086,265 | 4/1963 | Orenick et al. | 24/30.5 P |
| 3,102,311 | 9/1963 | Martin et al. | 24/30.5 P |
| 3,367,701 | 2/1968 | Wenk, Jr. | 24/16 PB |
| 3,717,906 | 2/1973 | Wells | 24/16 PB |
| 3,855,670 | 12/1974 | Brudy | 24/16 PB |
| 3,967,345 | 7/1976 | Sumimoto | 24/16 PB |
| 3,973,292 | 8/1976 | Bonnet | 24/16 PB |
| 3,983,603 | 10/1976 | Joyce | 24/30.5 P |
| 3,991,444 | 11/1976 | Bailey | 24/16 BP |

FOREIGN PATENT DOCUMENTS

| | | | |
|---|---|---|---|
| 484507 | 7/1976 | Australia . | |
| 920335 | 3/1963 | United Kingdom | 24/30.5 W |

*Primary Examiner*—Victor N. Sakran

*Attorney, Agent, or Firm*—Thomas W. Buckman; Jack R. Halvorsen

[57] ABSTRACT

A one piece plastic security seal including a generally rectangular housing having a strap integrally attached to said housing. A passageway in the housing, which is generally rectangular in shape, complimentary accepts the strap. The strap includes a plurality of barbs or teeth evenly spaced and offset from one another on opposite sides and opposing edges of the strap. Barbed means are provided within the passageway through the housing and complimentary with the strap barbs, said housing additionally being relieved adjacent opposite edges to provide resiliency to the internal barbs in the passageway.

6 Claims, 7 Drawing Figures

SECURITY SEAL

BACKGROUND OF THE INVENTION

The present invention relates to security seals and it refers particularly, though not exclusively, to security seals for use in sealing the openings of cash bags.

When money is transferred between banks and other offices generally the money is placed in bags which are then sealed, so as to prevent undetected removal of the contents or pilfering. One suitable method has been described in Australian Patent Specification No. 484,507. In the first embodiment described in the aforementioned specification an aluminum strap was inserted into a plastic housing and the housing crimped to retain the strap therein. With this embodiment it is difficult to obtain a tight seal on the cash bag because of the simultaneous manipulation of the crimping tool, strap and housing. The aluminum strap is also relatively expensive when compared with the cost of the plastic housing.

The second embodiment disclosed in the aforementioned specification provided a plastic strap which co-operated with a complicated mild steel buckle. In this construction the cost of the buckle compared with the strap is high.

In both embodiments disclosed in the aforementioned specification crimping must be effected by a special tool for the seal to operate correctly.

OBJECTS OF THE INVENTION

Accordingly it is an object of the present invention to provide a security seal that does not require crimping by a tool.

A further object of the invention is to provide a one-piece security seal which is cheap and simple to manufacture by mass production methods.

SUMMARY OF THE INVENTION

The present invention provides a security seal including a housing having a passageway therethrough, a strap attached to said housing and adapted to be received within said passageway, a plurality of barbs or teeth on said strap and at least one pawl or barb within said passageway adapted to engage with the bars or teeth on the strap.

Preferably the security seal is formed from a flexible thermoplastic material e.g. nylon.

In order that the invention may be clearly understood and readily put into practical effect there shall now be described with reference to the accompanying drawings a preferred embodiment of a security seal according to the invention.

DETAILED DESCRIPTION

Figure 1:
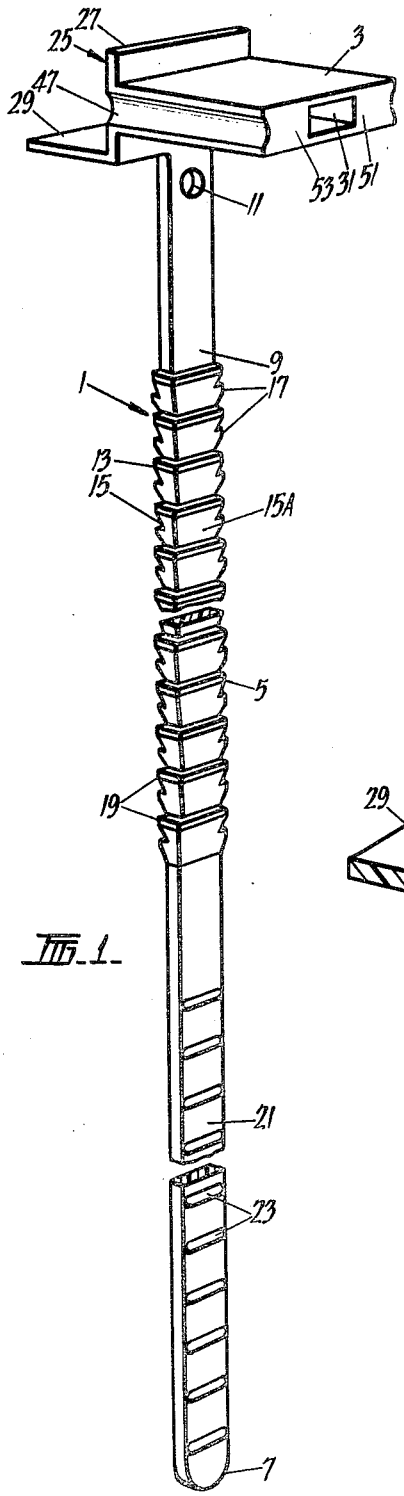
FIG. 1 is a rear perspective view of a seal made in accordance with the invention.

Referring to the drawings there is shown a security seal 1 formed from nylon and composed of two integral parts, a housing 3 and a strap 5.

Figure 2:
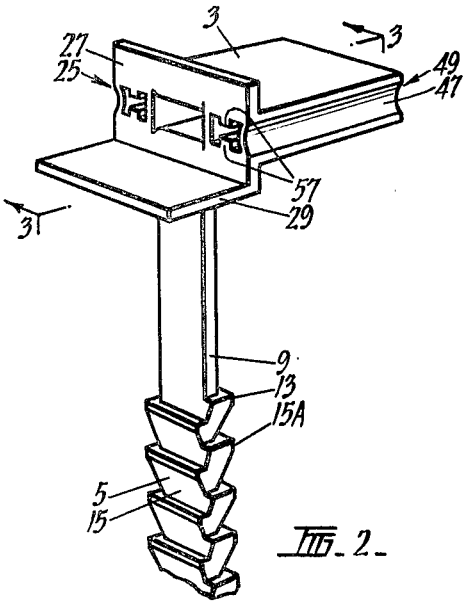
FIG. 2 is a front perspective view of part of the seal shown in FIG. 1.
Figure 4:
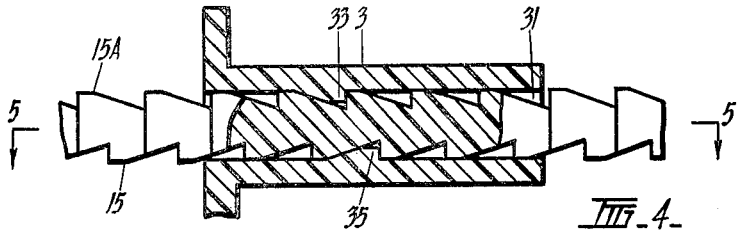
FIG. 4 is a cross-sectional view similar to that of FIG. 3 showing engagement of the strap.
Figure 5:
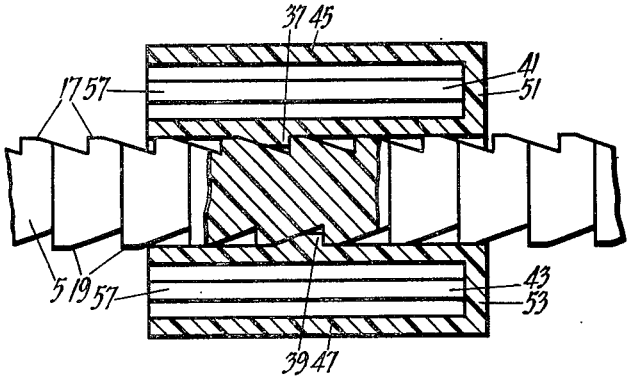
FIG. 5 is a cross-sectional view along line 5—5 of FIG. 4.

The strap comprises a generally rectangular strip of nylon with a rounded free end 7. The strap has three sections. The first section 9 adjacent the strap's connection with the housing is smooth and free of protrusions. This section is weakened by a hole 11 at which breakage will occur if an unauthorized attempt is made to remove the seal. The second section 13 has a plurality of saw-tooth shaped barbs 15, 15A thereon. These barbs 15, 15A are evenly spaced on both sides of the strap and are off-set from one another as better seen in FIGS. 2 and 4. The barbs 15 on one side project from one edge (as shown at 17) and the barbs 15A on the other side project from the other edge (as shown at 19) of the strap 5. The third section 21 of the strap is free of barbs and includes finger grips 23.

The housing 3 is generally rectangular of length and width substantially greater than the thickness. At the inner end 25 of the housing is a transverse flange 27 extending and protruding on both sides for the full width of the housing. A projection 29 is also provided normal to one end of the flange 27.

Figure 3:
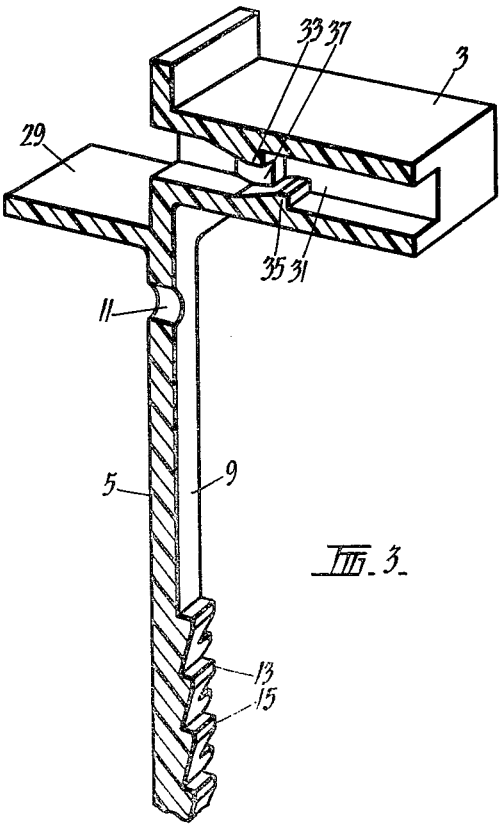
FIG. 3 is a rear perspective cross-sectional view along line 3—3 of FIG. 2.

A generally rectangular passageway 31 of slightly greater width than the strap 5 runs longitudinally through the housing 3. Within this passageway 31 are two barbs 33 and 35 (see FIGS. 3 and 4) on opposing sides thereof. The barbs 33 and 35 are complementarily shaped with the barbs 15 and 15A on the strap 5 and are off-set to the same degree. Addiitional barbs 37 and 39 are similarly positioned within the passageway 31 on the other sides thereof for engagement with projections 17 and 19. At each side of the passageway the housing is hollow (as shown at 41 and 43) from the inner end 25 to form thin concave arcuate outer side walls 45 and 47. The outer end 49 is closed by walls 51 and 53 to prevent tampering of the seal from that end. The strap 5 is attached to the projection 29 and, as made, extends in the same plane as the flange 27.

Figure 6:
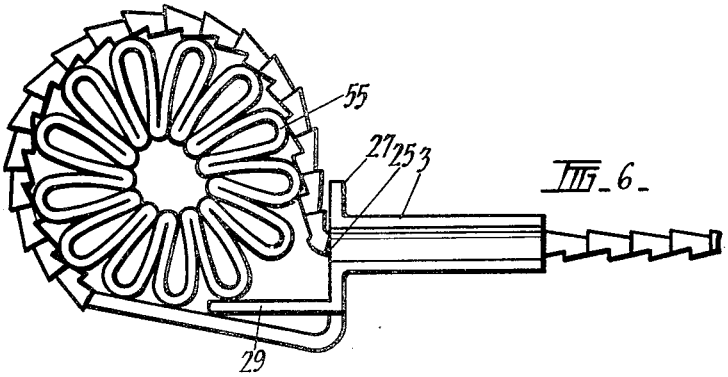
FIG. 6 shows the fitting of the seal to a money bag.
Figure 7:
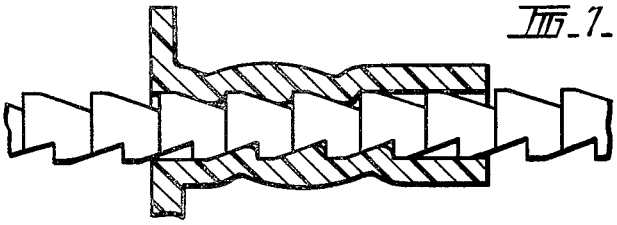
FIG. 7 is a similar view to that of FIG. 4 showing crimping of the seal.

In use, (see FIG. 6), the housing 3 of the seal is placed against the neck 55 of bag to be sealed with the flange 27 and projection 29 resting thereagainst. The strap 5 is looped around the neck 55 and inserted into the inner end 25 of the housing. The strap 5 is pulled tight whereupon projection 29 may distort to conform to the shape assumed by the mouth of the bag. The barbs 33, 35, 37 and 39 in the passageway 31 of the housing co-operate with the barbs 15, 15A and projections 17 and 19 of the strap to ensure sealing of the bag. The strap cannot be removed without damage to the strap or housing. The projection 29 serves as a cutting area or knife guard when cutting the strap for authorized removal of the seal and reduces the risk of cutting of the bag.

The invention has an additional advantage in that the housing may also be crimped similarly to the seal discussed in the previously mentioned patent specification for additional strength. To further increase the engagement and locking of the passageway barbs the inner walls of passageway 31 are arcuate (not shown). Thus when crimped the arcuate inner walls deform to bias the passageway bars towards the strap.

The use of nylon enables dye to be absorbed into the housing. Thus when the seal is dyed and the housing subsequently deformed and embossed, the embossment is high-lighted due to the deformation which will accentuate the base colour of the nylon through the dyed surface. To improve the legibility of the embossing, ribs 57 are provided which when crimped, abut each other.

It will be understood that many modifications may be made in details of design and/or construction without departing from the ambit of the invention, the nature of which is to be ascertained from the appended claims.

I claim:

1. A one piece plastic security seal including a generally rectangular housing having a generally rectangular passageway therethrough, an elongated strap attached to said hoousing and adapted to be received in a complimentary fashion within said passageway, a plurality of bars or teeth on said strap which are evenly spaced and offset from one another on opposite sides of the strap, barbs or teeth on each edge of the strap which are evenly spaced and offset from the barb or tooth on the opposite edge of the strap, a plurality of barbs or pawls within said passageway on opposing inner walls and offset from each other whereby said wall supported barbs adapted to engage the offset barbs on said strap, portions of said housing adjacent the walls engaging the edges of said strap being relieved to provide resiliency to the barbs or pawls at engaging side edges.

2. A security seal as claimed in claim 1 wherein said strap has a weakened area adjacent its attachment to said housing.

3. A security seal as claimed in claim 1 wherein said housing includes a transverse flange extending and protruding on both sides for the full width of the housing.

4. A security seal as claimed in claim 3 wherein a projection is provided normal to one end of the flange and the strap is attached to said projection in the same plane as said flange.

5. A security seal as claimed in claim 1 wherein the housing relief means at each side of said passageway includes an axially extending section with thin arcuate outer and inner side walls.

6. A security seal as claimed in claim 5 wherein oppositely facing ribs are provided within said hollow section which are adapted to abut one another upon crimping of the seal.

* * * * *